US006005523A

United States Patent [19]

Rudisill

[11] Patent Number: 6,005,523

[45] Date of Patent: Dec. 21, 1999

[54] ANTENNA ROD DISCONNECT MECHANISMS AND ASSOCIATED METHODS

[75] Inventor: Charles A. Rudisill, Apex, N.C.

[73] Assignee: Ericsson Inc., Research Triangle Park, N.C.

[21] Appl. No.: 08/989,214

[22] Filed: Dec. 11, 1997

[51] Int. Cl.[6] ..... H01Q 1/24

[52] U.S. Cl. ..... 343/702; 343/752; 343/900

[58] Field of Search ..... 343/700 MS, 702, 343/895, 715, 900, 749, 752; H01Q 1/24, 1/36

[56] References Cited

U.S. PATENT DOCUMENTS 5,374,937 12/1994 Tsunekawa et al. ..... 343/702
5,438,339 8/1995 Itoh et al. ..... 343/895
5,467,096 11/1995 Takamoro et al. ..... 343/702
5,583,518 12/1996 Nariyama ..... 343/702
5,583,519 12/1996 Koike ..... 343/702
5,594,459 1/1997 Hirota ..... 343/749
5,691,730 11/1997 Egashira et al. ..... 343/702
5,764,191 6/1998 Tsuda ..... 343/702

*Primary Examiner*—David H. Vu
*Assistant Examiner*—Tho Phan
*Attorney, Agent, or Firm*—Myers Bigel Sibley & Sajovec, P.A.

[57] ABSTRACT

A retractable antenna assembly with a rod disconnect mechanism includes a conductive resilient member positioned intermediate the top load element and the rod. The resilient member translates in a transverse direction corresponding to the extension and retraction of the antenna to disconnect the rod from the top load element when the antenna is retracted.

32 Claims, 7 Drawing Sheets

ANTENNA ROD DISCONNECT MECHANISMS AND ASSOCIATED METHODS

FIELD OF THE INVENTION

The present invention relates generally to communication equipment and more particularly relates to retractable antennas used with communication equipment.

BACKGROUND OF THE INVENTION

Many types of communication equipment such as radiotelephones employ retractable antennas, i.e., antennas which are extendable and retractable out of the unit's housing. The retractable antennas are electrically connected to a signal processing circuit positioned on an internally disposed printed circuit board. In order to optimally operate, the signal processing circuit and the antenna should be interconnected such that the respective impedances are substantially "matched." Unfortunately, complicating such a matching system, a retractable antenna by its very nature has dynamic components, i.e., components which move or translate with respect to the housing and the printed circuit board, and thus does not generally have a single impedance value. Instead, the retractable antenna typically has different impedance values when in an extended versus a retracted position. Therefore, it is preferred that the impedance matching system alter the antenna's impedance to properly match the terminal's impedance both when the antenna is retracted and extended.

The physical configuration of the switching system and matching network can be further complicated by the miniaturization of the unit and the internally disposed printed circuit board. Many of the more popular handheld telephones are undergoing miniaturization to the point where many of the contemporary models are only 11–12 centimeters in length. Because the printed circuit board is disposed inside the radiotelephone, its size is also shrinking, corresponding to the miniaturization of the portable radiotelephone. Unfortunately, as the printed circuit board decreases in size, the amount of space which is available to support desired operational and performance parameters of the radiotelephone is generally correspondingly reduced. Therefore, it is desirable to efficiently and effectively utilize the limited space in the radiotelephone and on the printed circuit board.

Miniaturization can also create complex mechanical and electrical connections with other components such as the outwardly extending retractable antenna which must generally interconnect with the housing for mechanical support, and, as discussed above, to an impedance matching system operably associated with the printed circuit board in order for the signal to be optimally processed. These retractable antennas generally include a top load element and a rod element.

As is well known to those of skill in the art, retractable antennas typically operate with desired matching circuits, one associated with the extended position and one with the retracted position. In the extended position, the antenna typically operates as a half-wave ($\lambda/2$) load (the load attributed to the top load element and the rod). In this situation, the associated impedance may rise as high as 600 Ohms. In contrast, in the retracted position, the antenna rod generally operates as a quarter-wave ($\lambda/4$) load with an impedance typically near 50 Ohms (the load associated with the top load element). Therefore, when the antenna is in the extended position an L-C matching circuit may be needed or desired to match out the additional impedance.

Conventional portable radiotelephones use a variety of antenna connections to switch matching systems into the receive circuit according to the position of the antenna. For example, U.S. Pat. No. 5,374,937 to Tsunckawa et al. proposes downwardly spaced-apart contacts or terminals on the printed circuit board in the radiotelephone housing which act to engage with or short out the associated matching network. Unfortunately and disadvantageously, this type of switching connection can employ a number of lower reliability discrete switching components such as wiping contacts with multiple signal feed points and additionally may use an undesirable amount of space on the printed circuit board. Further, the rod remains in contact with the top load element (such as a helix) and can detune or degrade the operating characteristics of the antenna or can allow noise to be introduced into the telephone through the rod when the antenna is retracted.

One alternative is described in a co-pending patent application, Ser. No. 08/858,982, filed May 20, 1997, and assigned to the assignee of the present application entitled "Radiotelephones with Antenna Matching Switching System Configurations" by Gerard J. Hayes and Howard E. Holshouser. This system employs transversely spaced-apart circuit and antenna contacts to reduce the amount of space on the printed circuit board needed to operate the matching system. An additional alternative is described in a co-pending application, Ser. No. 08/841,193, filed Apr. 29, 1997, entitled "Radiotelephones with Integrated Antenna Matching Systems" by Howard E. Holshouser. Each of these references is hereby incorporated by reference as if recited in full herein.

OBJECTS AND SUMMARY OF THE INVENTION

It is therefore a first object of the present invention to provide a mechanism which can electrically and mechanically disconnect the top load element from the antenna rod element corresponding to the retraction of the antenna.

It is yet another object of the present invention to provide a retractable antenna assembly which can disconnect the rod portion of the antenna from the helix in the retracted position to minimize any performance degradation of the antenna or to minimize the introduction of undesirable noise input from the antenna to the signal processing circuit.

It is a further object of the present invention to provide a retractable antenna assembly with a matching system which is automatically switched to a desired signal path via a single feed point corresponding to the physical retraction and extension of the antenna.

It is still another object of the present invention to provide a rod disconnect mechanism for retractable antennas which employs a minimal number of moving contacts and minimizes the size of the antenna to disconnect the rod element from the top load element when the antenna is in the retracted position.

These and other objects are satisfied by the present invention which provides a rod disconnect mechanism which employs a resilient member such as a flexure spring to disconnect the rod from the top load element when the antenna is in the retracted position. In particular, a first aspect of the invention includes a retractable antenna with a top load element. The assembly includes a flexure spring in electrical communication with the top load element. The flexure spring has at least one transversely extending tongue thereon. The antenna also includes a longitudinally extending rod element detachably connected to the flexure spring and a base contact ring having an inner surface configured to receive the retractable antenna. In the retracted position, the flexure spring tongue is translated inwardly by contact with the base ring inner surface to electrically disconnect the rod element from the flexure spring and the top load element. In a preferred embodiment, the flexure spring is a conductive planar wafer.

Advantageously, the present invention configures the antenna top load element, the flexure spring (as noted, preferably a flexible thin wafer-like conductive spring), the rod element, and the base unit to define first and second signal paths which are automatically switched corresponding to the translation of the antenna. In particular, the first signal path is operative when the antenna is extended and the second signal path is operative when the antenna is retracted. Further, the instant invention advantageously disconnects the rod element from the top load element when the antenna is retracted. This can reduce the need to provide additional shielding components for the rod to attempt to remove or reduce noise problems typically associated therewith. Further advantageously, the disconnect mechanism removes the rod from the signal path such that it does not affect the matching characteristics of the antenna in the retracted position.

Preferably, the antenna assembly incorporates a single radio frequency (RF) feed point into the signal processing unit to reduce the amount of space inside the unit (e.g., the radiotelephone)—as well as on the printed circuit board—needed to switch and match the impedance of the antenna.

In a preferred embodiment, the resilient member (such as a flexure spring) has a rod element opening through the center thereof and the flexure spring is preloaded with a first load to contact the rod element when the antenna is extended. In contrast, when the flexure spring tongue is translated inwardly (corresponding to the retraction of the antenna) it introduces a second load onto the flexure spring, causing the flexure spring opening to be enlarged and causing the flexure spring to be spaced apart from the rod element.

An additional aspect of the present invention is a retractable antenna assembly which comprises a top load element, a conductive flexure spring positioned to contact the top load element, and a rod element spaced apart from the top load element and detachably connected to the flexure spring. When the antenna is in the retracted position the conductive flexure spring is detached from the rod element thereby electrically disconnecting the rod element from the top load element.

In a preferred embodiment, the retractable antenna assembly comprises a retractable antenna with a top load element and a rod element spaced apart from the top load element. The assembly also includes a rod disconnect mechanism positioned intermediate of the top load element and the rod element. The rod disconnect mechanism is configured to transversely translate from a first position to a second position corresponding to the longitudinal extension and retraction of the antenna respectively. When the rod disconnect is in the first position, the top load element, the rod disconnect mechanism, and the rod element are in electrical communication. In contrast, when the rod disconnect is in the second position, the top load element and the rod disconnect element are in electrical communication and the top load element is disconnected from the rod element.

Preferably, the rod disconnect mechanism comprises a resilient member and a bottom retaining plate configured to receive the resilient member therein, such that the resilient member is compressed with a first transverse load. The rod disconnect also preferably includes a top retaining plate configured to overlay the resilient member opposite the bottom retaining plate. Further preferably, the resilient member, the bottom retaining plate, and the top retaining plate each include an aligned opening therein. The openings configured to receive a portion of the antenna rod therethrough.

It is also preferred that the resilient member be pre-loaded with a first load to force the resilient member to contact the rod element when the antenna is extended (or not fully retracted). Further, the resilient member preferably includes a tongue thereon and when the tongue is translated inwardly it introduces a second load onto the resilient member causing the resilient member opening to deform such that the resilient member is electrically and mechanically disconnected from the rod element. In one embodiment, the resilient member is configured substantially as a parallelogram in the second load condition and configured substantially as a rectangle in the first load condition. Advantageously, the shape deforms corresponding to the transverse load introduced thereon causing the resilient member opening to connect or disconnect with the rod element of the antenna while maintaining electrical contact with the top load element of the antenna. The load differential corresponds to the translation of the antenna.

Yet another aspect of the invention is directed towards a rod disconnect mechanism similar to that described above in the retractable antenna assembly. Advantageously, the rod disconnect mechanism can be configured as a relatively thin component which adds little to the overall length of the antenna and employs only one moving contact.

An additional aspect of the present invention is a method for disconnecting the rod element from the top load element when the antenna is retracted. The method includes positioning the resilient member with a center rod element opening intermediate of the top load element and the rod element such that the top load element and the rod element are in electrical communication with the resilient member. A first pre-load is introduced onto the resilient member causing the member to electrically contact the antenna rod. A second load is introduced onto the resilient member when retracting the antenna. The second load deforms the resilient member to electrically disconnect the member from the rod element, thereby disconnecting the top load element from the rod element (while maintaining electrical contact between the resilient member and top load element).

Thus, as described above and in more detail herein, the instant invention advantageously disconnects the rod element from the top load element when the antenna is retracted and re-engages the rod element upon extension of the antenna. This can minimize and even remove the need to provide additional shielding components for the rod to attempt to remove or reduce noise problems typically associated with the rod when the antenna is retracted. Further advantageously, the disconnect mechanism removes the rod from the signal path such that it does not affect the operating characteristics of the antenna in the retracted position. Still further advantageously, a preferred embodiment of the instant invention employs an antenna assembly which incorporates a single rf feed point into the signal processing unit which minimizes the amount of space inside the unit (e.g., the radiotelephone)—as well as on the printed circuit board—needed to switch and match the impedance of the antenna.

The foregoing and other objects and aspects of the present invention are explained in detail in the specification set forth below.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. In the figures, certain regions, features and layers may be exaggerated for clarity.

In the description of the present invention that follows, certain terms are employed to refer to the positional relationship of certain structures relative to other structures. As used herein, the term "longitudinal" and derivatives thereof refer to the general direction defined by the longitudinal axis of the antenna associated with communication equipment such as a radiotelephone housing that extends upwardly and downwardly between opposing top and bottom ends of the radiotelephone when held in the hand of a user. As used herein, the terms "outer", "outward", "lateral" and derivatives thereof refer to the direction defined by a vector originating at the longitudinal axis of the radiotelephone and extending horizontally and perpendicularly thereto. Conversely, the terms "inner", "inward", and derivatives thereof refer to the direction opposite that of the outward direction. Together the "inward" and "outward" directions comprise the "transverse" direction.

Figure 1B:
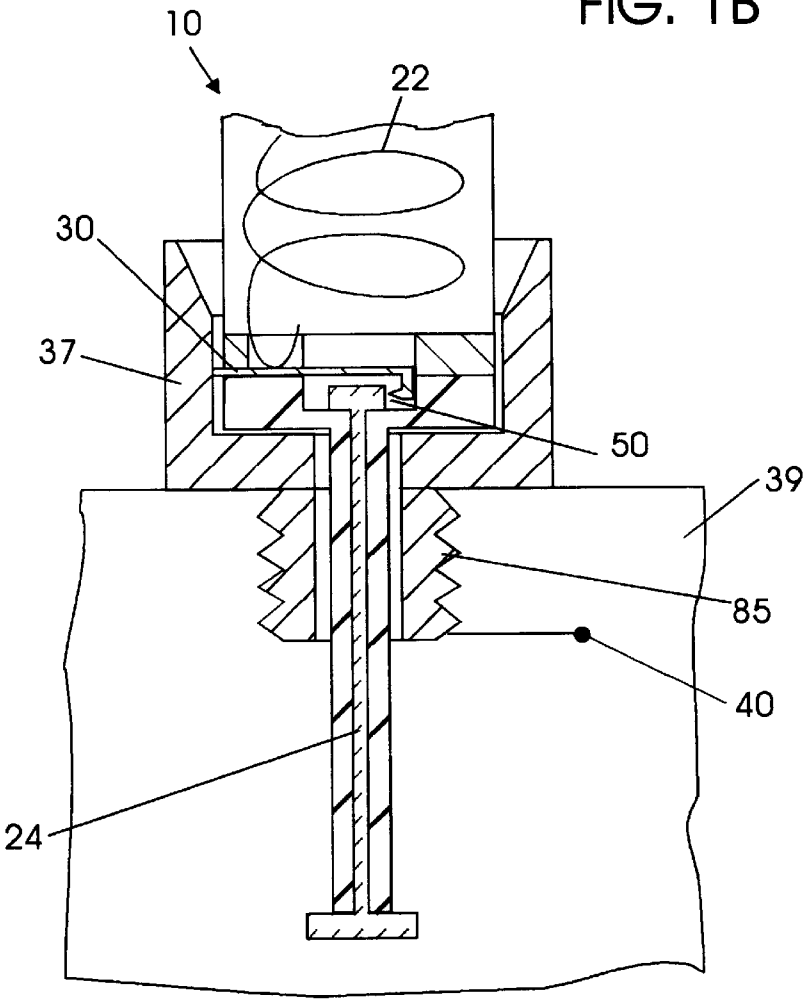
FIG. 1B is a schematic view of the retractable antenna assembly of FIG. 1A illustrating the antenna in the retracted position according to the present invention.
Figure 1A:
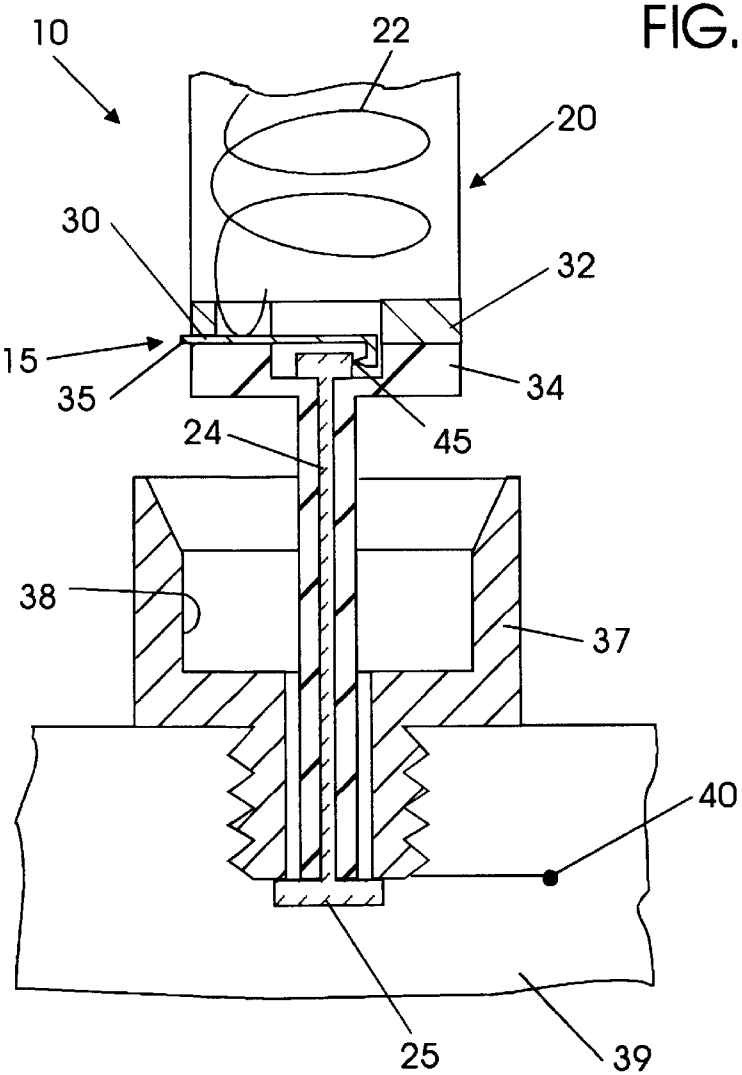
FIG. 1A is a schematic view of a retractable antenna assembly illustrating the operation of a rod disconnect mechanism when the antenna is in an extended position according to the present invention.

Referring now to the drawings, FIGS. 1A and 1B illustrate operation of a retractable antenna assembly 10 which employs a rod disconnect mechanism 15 according to the present invention. The antenna assembly 10 includes an antenna 20 with a top load element such as a helix 22 and a rod element 24. As shown, the rod disconnect mechanism 15 is positioned along the length of the antenna 20 intermediate of the rod element 24 and the top load element 22. The rod disconnect mechanism 15 includes a resilient member 30 held in longitudinal alignment between top and bottom retainer plates 32, 34. As shown, a tongue or outwardly extending protrusion 35 extends a predetermined distance outside the retaining plates 32, 34. The assembly 10 also includes a base unit 37 which is configured to receive a portion of the top load element 22 when the antenna is in a retracted position (FIG. 1B). The base unit 37 includes a conductive inner surface 38 which contacts the resilient member 30 when the antenna top load element 22 is received therein. The base unit 37 is preferably mounted to the housing 39 of communication equipment in a way which transmits the communication (RF) signal via a single RF feed point 40.

FIG. 1A illustrates the antenna in an extended or non-retracted position. In this position, the top load element 22, the resilient member 30, and the rod element 24 are in electrical communication. In contrast, as shown in FIG. 1B, when the antenna is retracted, the rod disconnect mechanism 15 disconnects the rod 24 from the top load element 22. In particular, upon retraction into the base unit 37, the inner surface 39 of the base unit pushes the tongue 35 of the resilient member 30 inwardly. This movement or transverse translation moves the contact end of the resilient member away from the rod element 24 and breaks the contact (electrically and mechanically) between the rod element 24 and the resilient member 30, therefore detaching the helix or top load element 22 from the rod 24.

Advantageously, the present invention configures the antenna top load element 22, the resilient member 30, the rod element 24, and the base unit 37 to define first and second signal paths which are automatically switched corresponding to the longitudinal translation of the antenna. In particular, the first signal path is operative when the antenna 20 is extended and the second signal path is operative when the antenna is retracted. As shown in FIG. 1A, the first signal path (extended) is defined by the top load element 22 which is connected to and contacts the resilient member 30. In turn, the resilient member 30 contacts the rod element 24 (at position indicated by 45) and the rod element 24 electrically contacts the rf feed 40 in the bottom of the base unit positioned in the housing 39. The rod preferably includes an anchor portion 25 to retain it in the housing or base unit 37. As shown in FIG. 1B, the second signal path is defined by the top load element 22, the resilient member 30, and a top portion of the base unit 37. Preferably, the tongue 35 of the resilient member contacts a conductive inner surface 38 of the base unit 37 transmitting the signal thereat. Of course, as will be appreciated by those of skill in the art, other means for connecting the top load element to the signal path independent or apart from the rod disconnect mechanism can also be employed. In any event, as shown in FIG. 1B, the rod 24 is disconnected (at position indicated by 50) and forms no part of the circuit in this position. Thus, the instant invention advantageously disconnects the rod element 24 from the top load element 22 when the antenna 20 is retracted. This can minimize and even remove the need to provide additional shielding components for the rod 24 to attempt to remove or reduce noise problems typically associated therewith. Further advantageously, the disconnect mechanism 15 removes the rod 24 from the signal path such that it does not affect the matching characteristics of the antenna 20 in the retracted position. Preferably, as shown in FIGS. 1A and 1B, the antenna assembly 10 incorporates a single rf feed point 40 into the associated unit which minimizes the amount of space needed inside the unit (e.g., the radiotelephone)—as well as on the printed circuit board—to match the impedance of the antenna. As illustrated throughout, the top load element is shown as a helix. However, as is well known to those of skill in the art, the antenna can be alternatively configured. Thus, although described as a top loaded monopole that operates as a half wave in the extended position and a quarter wave stub (helical spiral) in the retracted position, the invention is not limited to this antenna load or configuration as alternative antenna configurations can also be employed in the instant invention. For example, an antenna load which has an integer multiple of a half-wave length, or a coil, disc or other type antenna load element.

Figure 2:
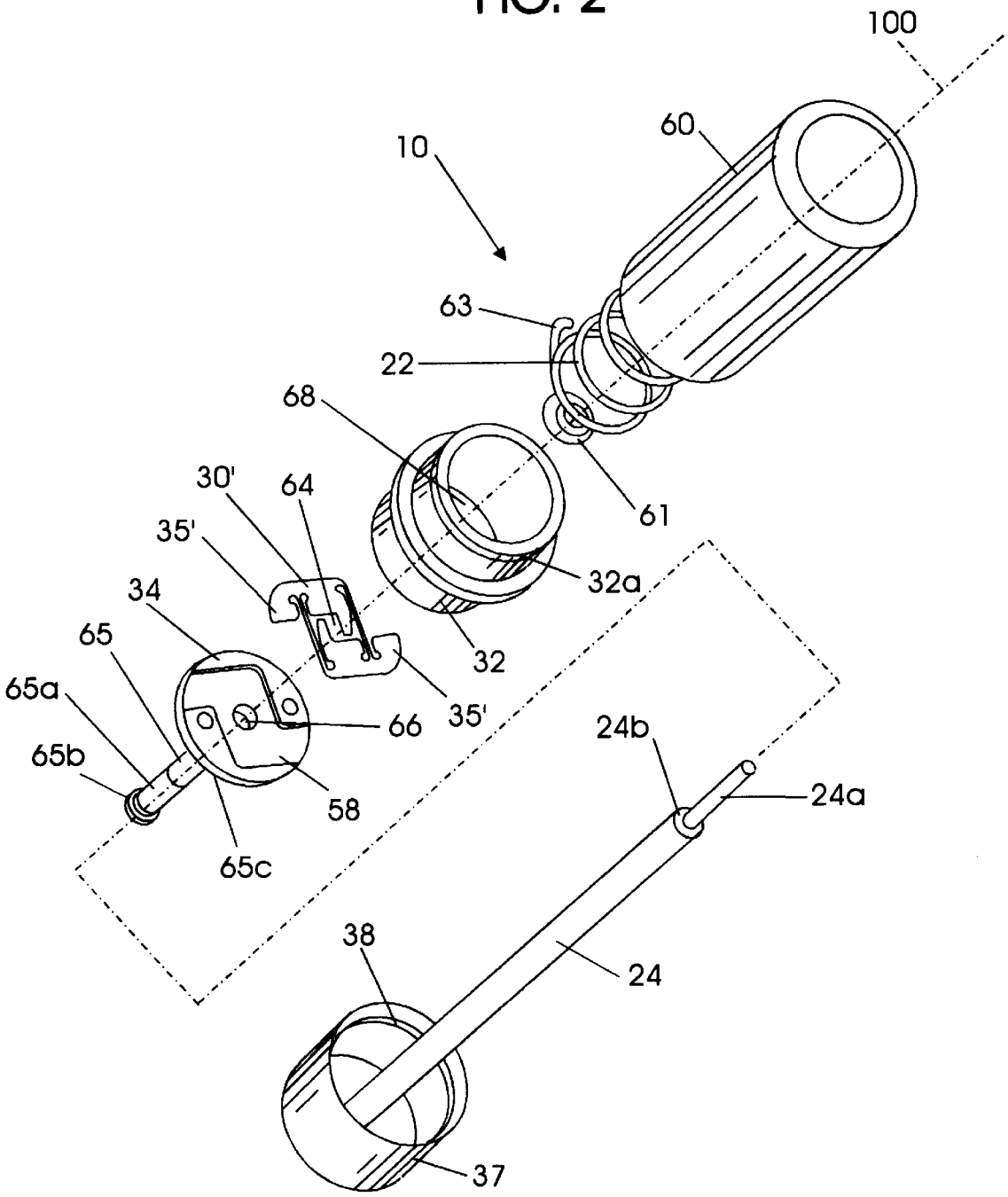
FIG. 2 is an exploded perspective view of one embodiment of a retractable antenna assembly according to the present invention.

Turning now to FIG. 2, an exploded view of a preferred embodiment of an antenna assembly 10 according to the present invention is illustrated. In this embodiment, the resilient member 30 is a flexure spring 30'. The flexure spring 30' is preferably a small, thin wafer-like conductive spring. For example, a planar spring with a profile of about 7.5 mm width by about 0.007–0.008 inches thick. Such a flat, thin profile minimizes the weight and height added to the antenna assembly. Of course alternative configurations and sizes may also be employed and function according to the present invention.

As shown in FIG. 2, the top load element is a helix 22 which is positioned inside of a helix sheath 60. The bottom end of the helix 22 is configured with a contact protrusion 63 portion which extends down to contact a surface of the flexure spring 30'. However, as will be known to those of skill in the art, other means of electrically engaging the helix with the resilient member 30 or flexure spring 30' may also be employed.

As shown in FIG. 2, the flexure spring 30' is positioned intermediate the top and bottom retaining plates 32, 34. The flexure spring 30' is preferably conductive, while the top and bottom plates are preferably non-conductive, thereby directing the signal path through the flexure spring or resilient member 30, the helix 22, and depending upon the position of the antenna, the rod element 24. Examples of suitable materials for the retainer plates 32, 34 include but are not limited to, a polymer, plastic, or ceramic. Examples of suitable materials for the resilient member 30 or flexure spring 30' include but are not limited to a (heat treated, etched or hard temper) beryllium copper, phosphor bronze, or other suitable contact/spring material. Gold or gold over nickel or palladium-nickel plating may be applied for wear resistance and to improve or minimize contact resistance. Of course the material selected should be conductive and have appropriate tensile strengths and hysterisis to reliably function as described above.

Turning again to FIG. 2, the bottom plate 34 is configured to matably receive the flexure spring 30' therein. As shown, the bottom plate 34 includes a recess 58 which is slightly deeper than the thickness of the flexure spring 30' to retain and guide the transverse movement of the spring while preventing rotation. The top plate 32, sandwiches the flexure spring 30' against the bottom plate 34 capturing the spring completely and preventing rotation and longitudinal displacement of the spring. Of course, additional locating pins and the like (not shown) may be added to the top and/or bottom plates 32, 34 to aid in alignment and to prevent rotation of the plates 32, 34 relative to one another. The retainer plates 32, 34 are also preferably configured to allow a portion (shown as a tongue 35') of the resilient member 30 or flexure spring to extend transversely outward of the assembled plates 32, 34 a predetermined distance and to freely move in a planar direction substantially perpendicular to the longitudinal axis of the antenna in response to a transverse force exerted on the tongue 35'. The transverse force preferably corresponds to the contact force exerted by the base unit inner diameter 38 when the antenna is retracted into the base unit 37.

Figure 3:
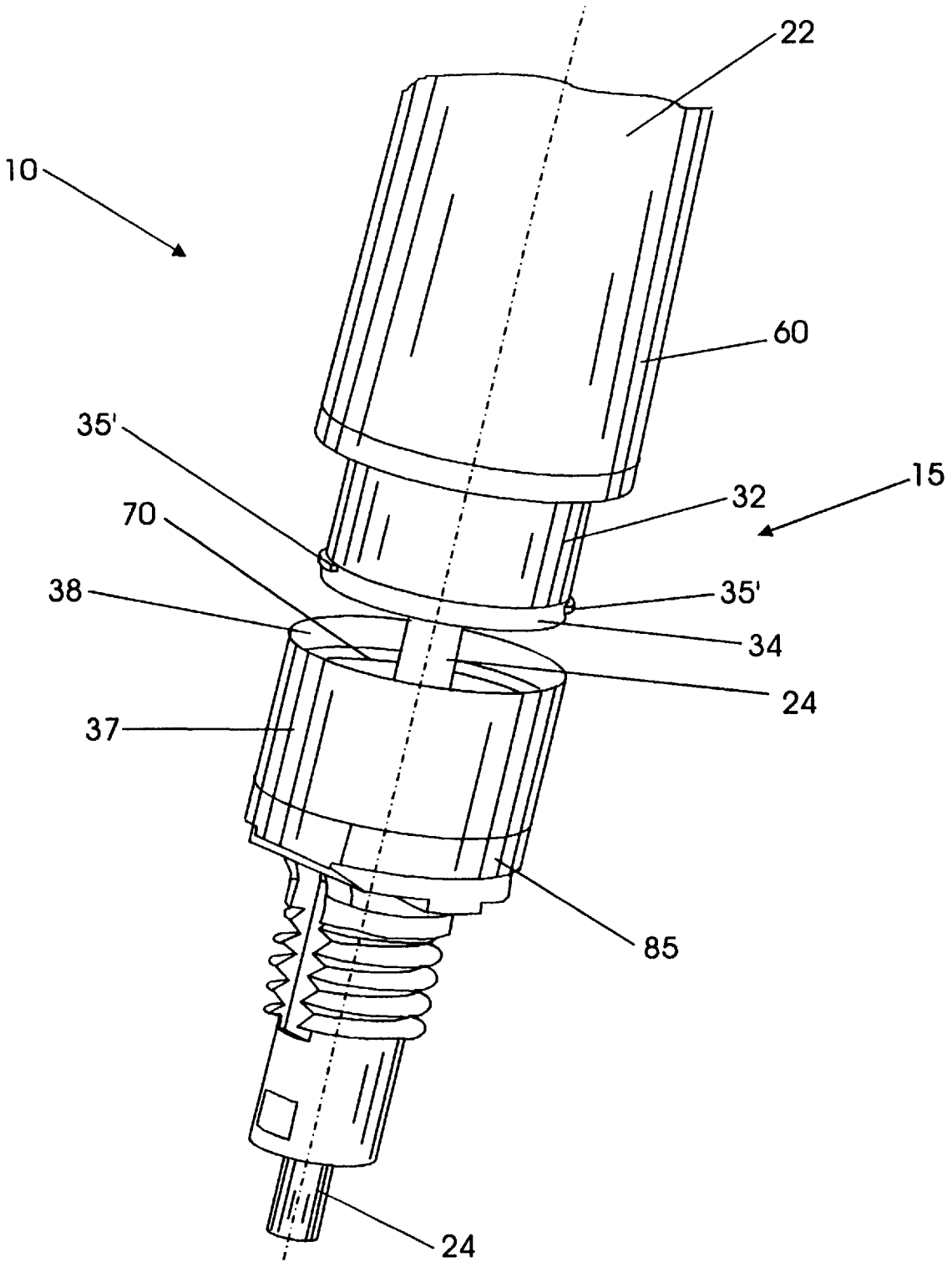
FIG. 3 is an enlarged perspective view of one embodiment of a retractable antenna assembly according to the present invention.

As shown in FIG. 3, the outside diameters of the top and bottom plates 32, 34 are preferably slightly smaller than the inside diameter 38 of the base unit 37 at the contact area, that is at the base unit area the resilient member 30 or spring contacts when the antenna is retracted. The base unit 37 is preferably a cylindrical body which is statically positioned on or adjacent the housing of the communication unit such that the base unit is in electrical communication with a rf feed in the unit (FIG. 1). The base unit inner diameter 38 includes a conductive portion which is configured to align with the tongue 35' when the antenna is retracted. The inner diameter conductive portion can be provided as a conductive ring 70 (FIG. 3) inset into the base unit 37. Preferably, and as shown, the rod disconnect mechanism 15 includes two opposing tongues 35' which extend diametrically opposite and outward a predetermined distance from the assembled plates 32, 34. Two or more flexure spring tongue contacts 35' provide functional redundancy and reliability of the rod disconnect and provide increased electrical contact area. As shown, the tongues 35' each extend outward from the remaining plates a distance of about 0.006 inches.

Again referring to FIG. 2, the rod disconnect mechanism 15 is positioned intermediate of the top load element (shown as a helix) 22 and the rod element 24. A rod end contact 65 is attached to the end of the antenna rod 24. Any suitable attaching means can be employed such as but not limited to crimping, soldering, and using a conductive adhesive. The antenna rod contact 65 is attached to be in electrical communication with the rod element 24. Preferably, the rod element 24 includes a titanium core 24*a* and a non-conductive outer surface 24*b*. The rod contact 65 is attached to be in electrical communication with the rod conductive core 24*a*. Preferably, the rod contact 65 is configured with an enlarged diameter 65*a* which will result in a deflection of the flexure spring 30' when the spring is placed over and around this contact area.

In one embodiment, a typical rod contact 65 is about 1.22 mm diameter with a flexure spring central rod opening 64 smallest side opening sized at about 1.02 mm. This will "pre-load" the flexure spring 30' such that it has a first displacement from its non-loaded state of about 4 mils and a first pre-load displacement force of about 30 to 40 grams. The rod end contact 65 also preferably includes an enlarged section 65b in the end opposing the helix 22 in order to retain the rod contact 65 in the bottom retainer plate 34. The bottom retainer plate 34, the flexure spring 30', and the top retainer plate (in the end portion of the cylinder body shown) 32, each include a central opening 66, 64, 68 respectively. The openings 66, 54, 68 are aligned such that upon assembly the rod contact 65 can be received therein. In a preferred embodiment, the rod end contact 65 protrudes through the top plate 32, allowing assembly with a press-fit retainer ring 61. In this embodiment, the rod 24, the rod end contact 65, the bottom retainer plate 34, the flexure spring 30' and the top retainer plate 32 are assembled by pressing the retainer ring 61 onto the end 65*c* of the rod end contact 65. Of course, other attaching or assembly means can also be employed such as but not limited to, employing a rivet-like or bayonet structure positioned on the rod-end contact, or ultrasonically welding or bonding the retaining plates 32, 34 together. If alternative attaching means are used, care should be taken to prevent damage to the parts and to maintain the functional tolerances needed for operation of the mechanism. FIG. 3 illustrates the assembly of the rod 24 with the rod end contact 65, the top and bottom retaining plates 32, 34 and the flexure spring 30'.

Figure 4A:
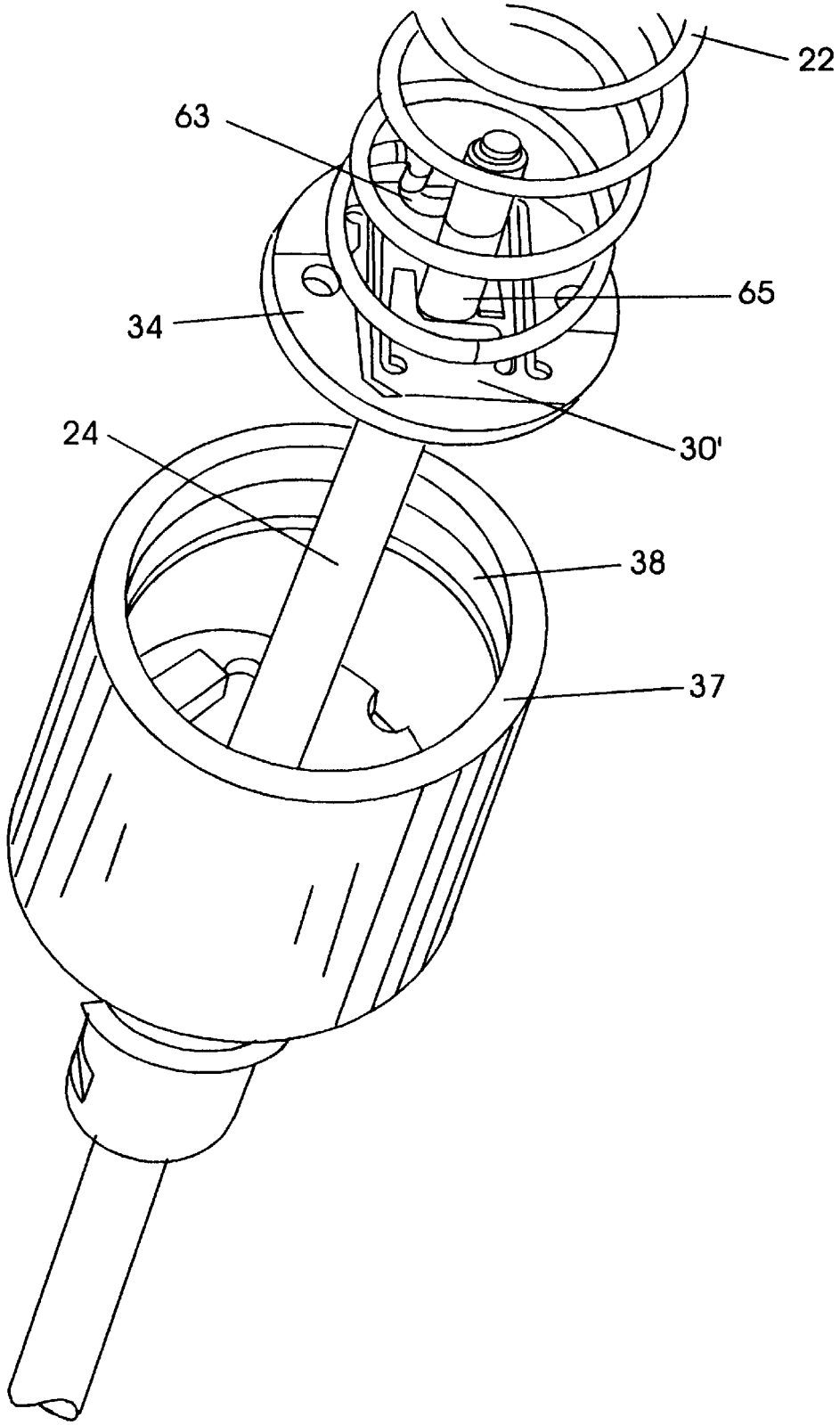
FIG. 4A is an enlarged perspective view of a rod disconnect mechanism without a top retaining plate illustrating the antenna in an extended position.
Figure 4B:
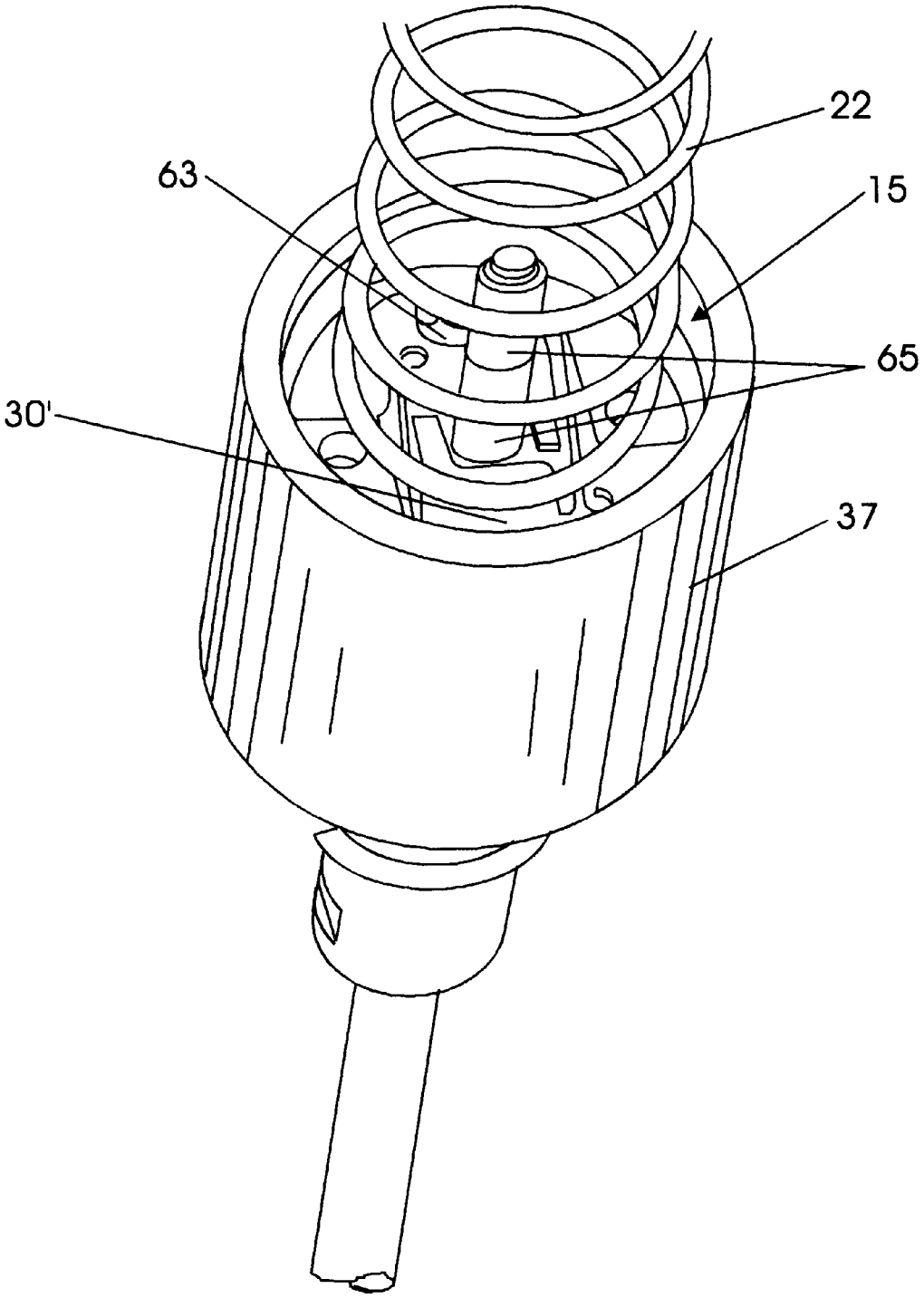
FIG. 4B illustrates the rod disconnect mechanism of FIG. 4A when the antenna is in a retracted position.

Referring to FIGS. 2, 4A, and 4B, the (conductive) helix 22 includes a lower portion with a contact protrusion 63 which extends down to contact a surface of the flexure spring 30'. Preferably, the abutting contact force (and electrical continuity) between the helix 22 and the flexure spring 30' is generated by the compression of the helix when the outer sheath 60 (FIG. 2) is installed over the helix and attached to the cylindrical body 32*a* housing the top retaining plate 32. As will be appreciated by those of skill in the art, other means of contacting the flexure spring 30' to the helix 22 can also be employed within the scope of the present invention. For example, a discrete contact can be formed on the end of the helix and threaded through a correspondingly sized passage in the top retaining plate 32 and folded over to be substantially parallel to and rest securely against the underside of the top retaining plate 32 such that it contacts the surface of the flexure spring 30' (not shown).

As schematically illustrated in FIGS. 1A and 1B, the base unit 37 of the antenna assembly 10 includes a conductive surface which is connected to the rf connection 40 in the communication equipment (i.e., telephone). As shown in FIG. 3, a machined conductive ring 70 with a taper on a top edge portion is attached to a molded base 37, the base 37 also includes matching circuitry for the antenna which is activated when the antenna is in the extended position. This base unit matching circuit design is described in co-pending application, Ser. No. 08/935,448, filed Sep. 23, 1997, entitled "Switchable Matching Circuits Using Three Dimensional Circuit Carriers" by Charles Rudisill, Attorney Docket number 8194-91. The contents of this application is hereby incorporated by reference as if recited in full herein. Of course, the invention is not limited thereto and other base and matching circuit configurations may also be employed. For example, one alternative is a machined metal piece with a cylindrical surface and threads which insert into a housing with the matching circuitry disposed in the housing on the printed circuit board.

Figure 5A:
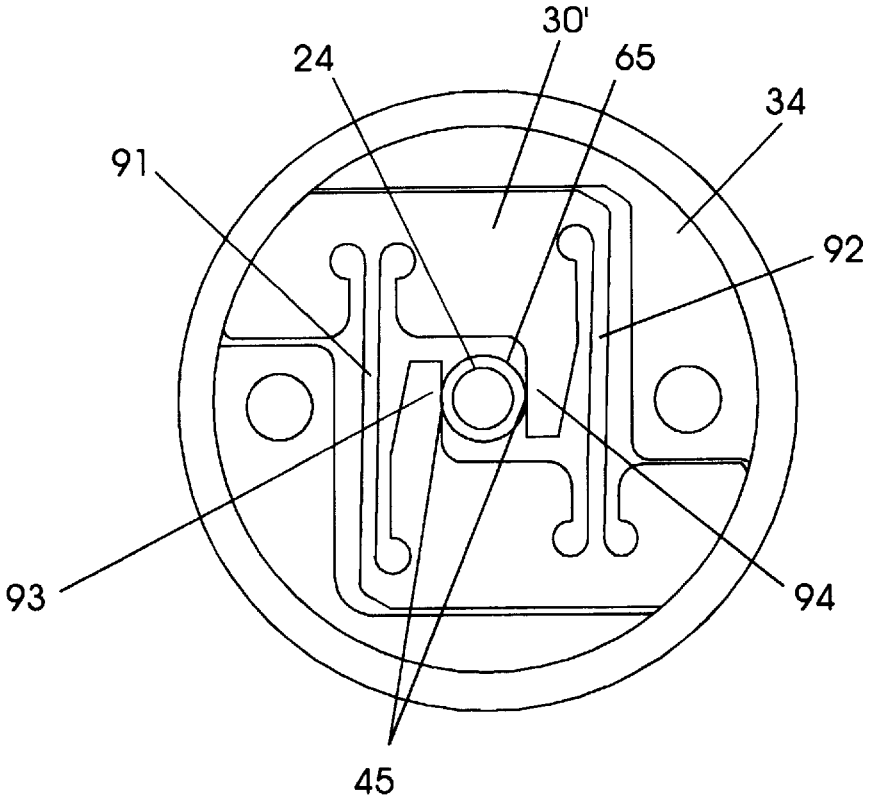
FIG. 5A is a greatly enlarged top view of a rod disconnect mechanism (without a top retaining plate)when the antenna is in an extended position according to the present invention.
Figure 5B:
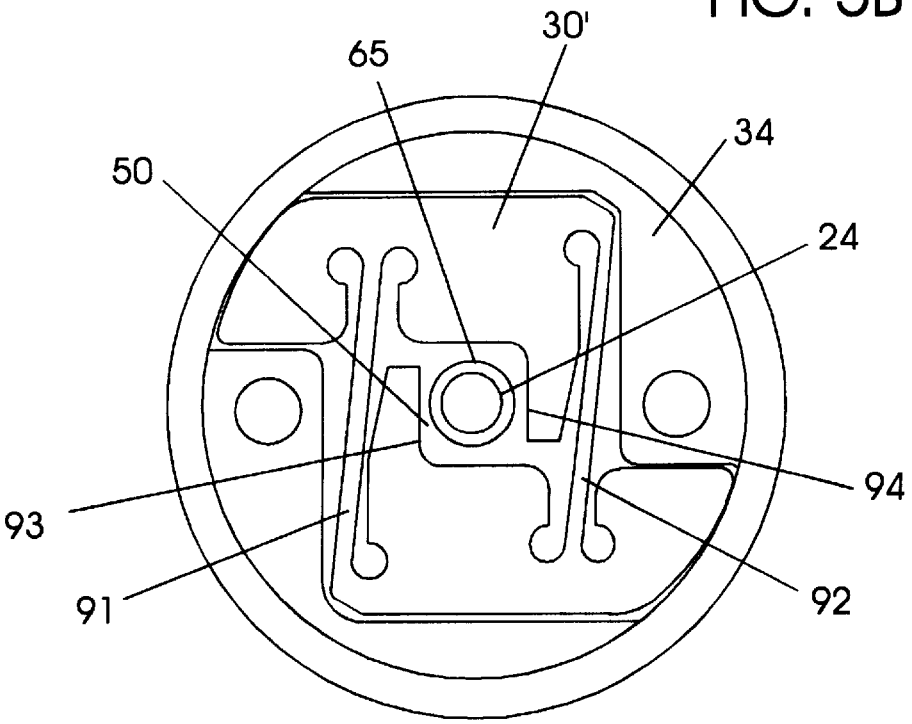
FIG. 5B illustrates the rod disconnect mechanism of FIG. 5A when the antenna is in the retracted position according to the present invention.

FIGS. 4A, 4B, 5A, and 5B illustrate the rod disconnect mechanism 15 without the top retaining plate 32 for a clearer view of the operation of the function of the flexure spring 30'. FIGS. 4A and 5A illustrate the antenna in the extended (in actuality in a non-retracted) position. As shown, the flexure spring contacts the rod 24 through the rod contact 65. FIGS. 4B and 5B illustrate the antenna in the retracted position. As shown, the flexure spring is detached from and spaced apart from the rod contact 65. This detachment corresponds to the deflection in the spring which in turn is caused by the transverse contact force exerted against the tongues 35'.

As shown in FIGS. 5A and 5B, the flexure spring 30' includes a central opening 64 and a symmetrical structural pattern (a pattern which is symmetric 180° rotation about center or a pattern repeated on opposing sides of the longitudinal axis ("the central axis" 100 in FIG. 2) of the antenna rod). The flexure spring 30' includes a pair of elongated arms 91, 92 which bridge the detachable rod contact portion (the jaws) 93, 94 of the spring 30' and connect the opposing sides together. As shown in FIG. 5A, in the pre-load condition, the elongated arms 91, 92 are substantially perpendicular and form a structure which is similar to a rectangular configuration. In contrast in the second load condition, as shown in FIG. 5B, the elongated arms 91, 92 are angled and substantially parallel to each other to form a structure which is similar to a parallelogram configuration. In an exemplary displacement, the pre-loaded spring 30' is deflected about 0.003–0.004 inches a side onto the rod end contact 65. The spring embodiment shown produces around 60 grams of contact force (second load) on the base unit 37 contact with about 0.003–0.008 inches of displacement per side to break contact with the rod contact 65. Thus, in the embodiment described, the spring can see about 0.006–0.012 total inches of displacement or deflection per side.

Figure 7:
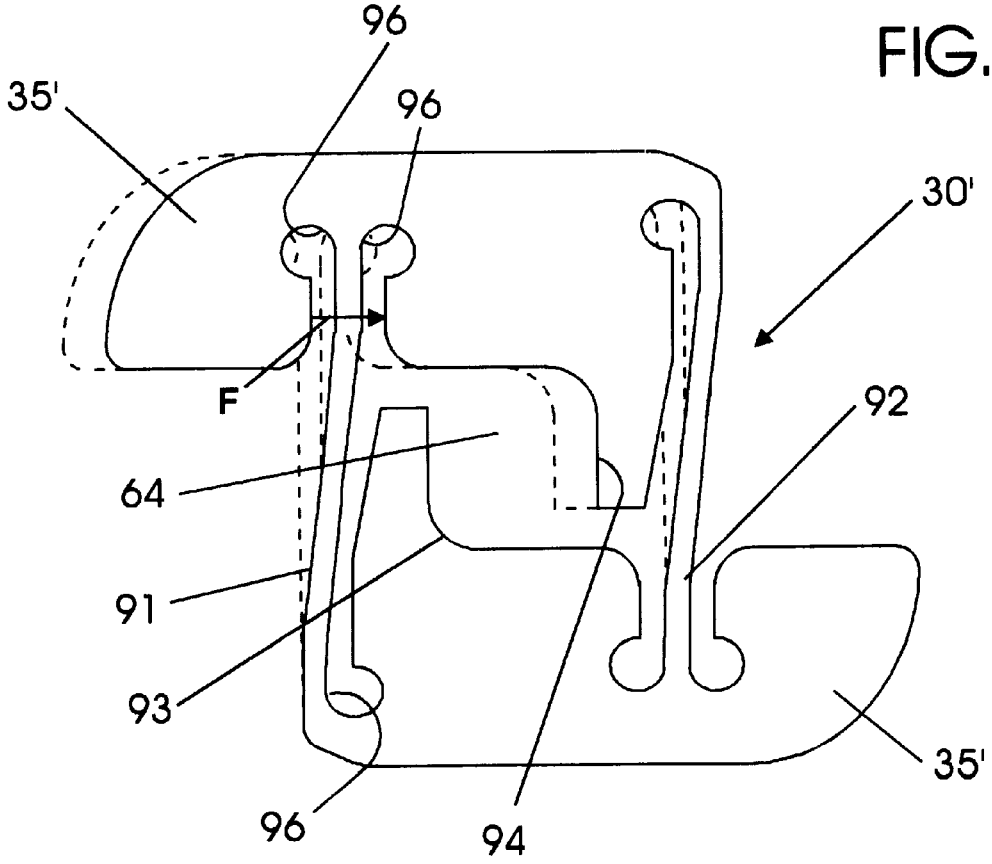
FIG. 7 illustrates the deflection of the resilient member shown in FIG. 6 when a transverse force is introduced thereon.

In a preferred embodiment, the beam length of the elongated arms is about 0.163 inches long with an associated width of about 0.008 inches. Also, as shown in FIG. 7, each arm 91, 92 is preferably connected to the spring body 30' via a radial undercut 96 to minimize stress risers and concentrations in these areas. The flexure spring 30' is preferably fabricated by photo etching or stamping. More preferably, the flexure spring 30' is fabricated by photo etching to produce the small feature size and preferred flatness and burr-free rounded corners. These dimensions produce acceptable stress levels for beryllium copper materials.

Figure 6:
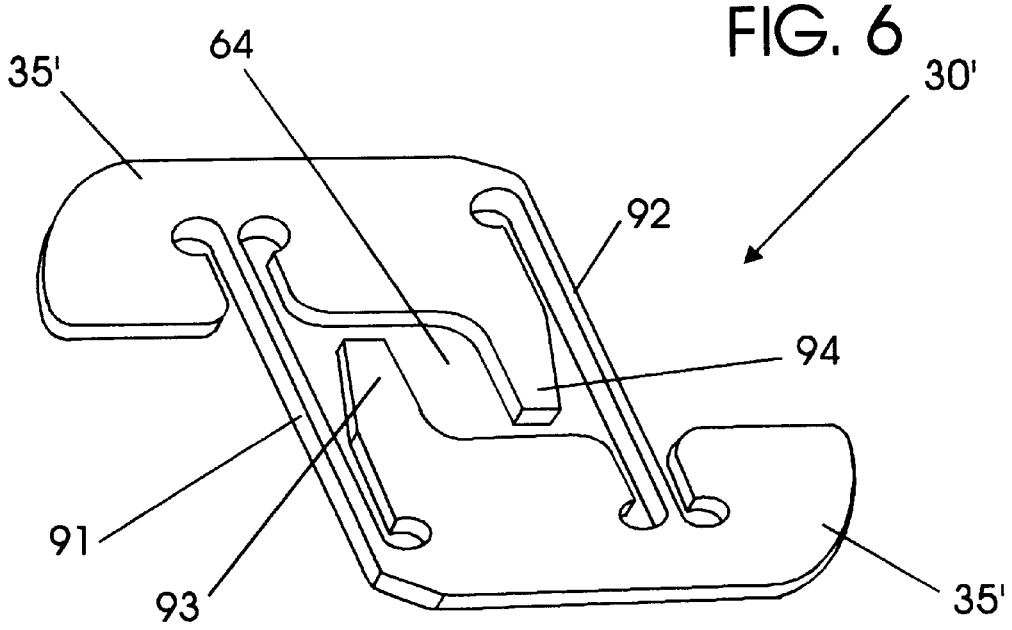
FIG. 6 is a greatly enlarged side perspective view of a resilient member for a rod disconnect mechanism according to one embodiment of the present invention.

FIGS. 6 and 7 illustrate an exaggerated profile of the spring 30'. FIG. 6 shows the spring at rest. FIG. 7 shows the spring 30' deflectioned with an applied exemplary load of about 0.25 lbs. (i.e., the deformed shape after application of a transverse load). The dotted line indicating the first position and the solid line indicating the deformed structure. FIG. 7 does not reflect similar movement of the tongue 35' on the right side of the drawing as would occur in a preferred embodiment. The different shadings along the leg of the spring generally indicate the areas of increased stress along the arms 91, 92.

Advantageously, this design allows for a low-profile disconnect mechanism. The overall height (the retaining plates and spring) is only about 1.8 mm. Further, the geometry of the flat contact area between the rod 24 and the flexure spring 30' mimimizes inductive coupling between the rod and spring. The mechanism is economical and relatively easy to assemble. Further, the geometry of the retaining plates helps shield the contacts from damage and acts such that the tongue contacts are self-aligning.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A retractable antenna assembly, comprising:

a retractable antenna, comprising:

a top load element;

a flexure spring in electrical communication with said top load element, said flexure spring having at least one transversely extending tongue thereon; and a longitudinally extending rod element detachably connected to said flexure spring; and a base contact ring having an inner surface configured to receive said retractable antenna, wherein when said antenna is in a retracted position, said flexure spring tongue is translated inwardly by contact with said base ring inner surface to electrically disconnect said rod element from said flexure spring and said top load element.

2. A retractable antenna assembly according to claim 1, wherein said flexure spring is a conductive planar wafer.

3. A retractable antenna assembly according to claim 2, wherein said planar wafer has symmetrical opposing first and second sides, each configured with a tongue thereon.

4. A retractable antenna assembly according to claim 2, wherein said flexure spring has a rod element opening through the center thereof, and wherein said flexure spring is pre-loaded with a first load to contact said rod element when said antenna is extended.

5. A retractable antenna assembly according to claim 4, wherein when said flexure spring tongue is translated inwardly it introduces a second load onto said flexure spring, causing said flexure spring opening to enlarge such that said flexure spring is spaced apart from said rod element.

6. A retractable antenna assembly according to claim 5, wherein said flexure spring is substantially configured as a parallelogram in the second load condition and substantially configured as a rectangle in the first load condition.

7. A retractable antenna according to claim 6, wherein said top load element includes a spring contact for electrically contacting said flexure spring.

8. A retractable antenna assembly according to claim 7, in combination with a radiotelephone, wherein said base contact ring is operably associated with a single RF feed point disposed in said radiotelephone.

9. A retractable antenna assembly according to claim 1, wherein said top load element, said flexure spring, said rod element, and said base contact ring define first and second signal paths which are switched corresponding to the translation of said retractable antenna.

10. A retractable antenna assembly according to claim 1, further comprising a top retaining plate and a bottom retaining plate, said retaining plates configured to hold said flexure spring therein such that said flexure spring tongue is free to move in the transverse direction and fixed in the longitudinal direction.

11. A retractable antenna assembly, comprising:

a top load element;

a substantially planar conductive flexure spring positioned to contact said top load element;

a rod element spaced apart from said top load element and detachably connected to said flexure spring, wherein when said antenna is in the retracted position said conductive flexure spring is detached from said rod element, thereby electrically disconnecting said rod element from said top load element.

12. A retractable antenna assembly, comprising:

a retractable antenna with a top load element and a rod element spaced apart from said top load element;

a rod disconnect mechanism positioned intermediate of said top load element and said rod element, said rod disconnect mechanism configured with a protrusion which transversely translates from a first position to a second position corresponding to the longitudinal extension and retraction of said antenna respectively, wherein when said rod disconnect mechanism is in said first position, said top load element, said rod disconnect mechanism, and said rod element are in electrical communication, and wherein when said rod disconnect is in said second position, said top load element and said rod disconnect mechanism are in electrical communication and said top load element is physically and electrically disconnected from said rod element.

13. A retractable antenna assembly according to claim 12, wherein said rod disconnect mechanism comprises:

a resilient member including said protrusion thereon;

a bottom retaining plate configured to receive said resilient member therein, such that said resilient member is compressed with a first transverse load; and a top retaining plate configured to overlay said resilient member opposite said bottom retaining plate.

14. A retractable antenna assembly according to claim 13, wherein said resilient member, said bottom retaining plate, and said top retaining plate each include an aligned opening therein, said opening configured to receive a portion of said rod element therein.

15. A retractable antenna assembly according to claim 14, wherein said resilient member is preloaded with a first load to force said resilient member to contact said rod element when said antenna is extended.

16. A retractable antenna assembly according to claim 15, wherein said resilient member is substantially configured as a parallelogram in an unloaded condition and substantially configured as a rectangle in the first load condition.

17. A retractable antenna assembly according to claim 14, wherein said resilient member protrusion is a tongue, and wherein when said tongue is translated inwardly it introduces a second load onto said resilient member, causing said resilient member opening to deform such that said resilient member is disconnected from said rod element.

18. A retractable antenna assembly according to claim 13, wherein said resilient member is a conductive planar wafer.

19. A retractable antenna assembly according to claim 18, wherein said planar wafer has symmetrical opposing first and second sides, each configured with a tongue thereon.

20. A retractable antenna assembly according to claim 13, wherein said retaining plates are configured to hold said resilient member therein such that said resilient member protrusion is free to move in the transverse direction and is substantially fixed in the longitudinal direction.

21. A retractable antenna according to claim 13, wherein said top load element includes a longitudinally extending electrical contact for electrically contacting said resilient member.

22. A retractable antenna assembly according to claim 12, further comprising a base unit with a cylindrical opening configured to receive said antenna therein, wherein said top load element, said rod disconnect mechanism, said rod element, and said base unit define first and second signal paths which are switched corresponding to the translation of said antenna in and out of said base unit.

23. A retractable antenna assembly according to claim 22, in combination with a radiotelephone, wherein said base unit is operably associated with a single RF feed point disposed in said radiotelephone.

24. A rod disconnect mechanism, comprising:

a resilient member;

a bottom retaining plate configured to receive said resilient member therein; and a linear antenna rod, said rod being longitudinally translatable during operation to a first extended position and a second retracted position, wherein said resilient member and said bottom retaining plate are configured to receive a portion of said rod therein, and wherein said resilient member transversely translates inward and outward to detachably disconnect and reconnect said rod from said resilient member corresponding to the longitudinal translation of said rod, and wherein said resilient member is deformable such that it has different perimeter configurations corresponding to the retracted and extended position of said rod.

25. A rod disconnect mechanism according to claim 24, further comprising a top retaining plate configured to overlay said resilient member opposite said bottom retaining plate.

26. A rod disconnect mechanism according to claim 25, wherein said resilient member, said bottom retaining plate, and said top retaining plate each include an aligned opening therein, said openings configured to receive a portion of said antenna rod therethrough.

27. A rod disconnect mechanism according to claim 24, wherein said resilient member is a conductive planar wafer.

28. A rod disconnect mechanism according to claim 27, wherein said planar wafer has symmetrical opposing first and second sides, each configured with a tongue thereon.

29. A rod disconnect mechanism according to claim 28, wherein said resilient member is configured substantially as a parallelogram when said tongue is translated transversely inwardly.

30. A rod disconnect mechanism according to claim 24, wherein said resilient member includes a tongue thereon and an opening formed therein, and wherein when said tongue is translated transversely inwardly said tongue introduces a load onto said resilient member, causing said resilient member opening to deform such that said resilient member is disconnected from the rod.

31. A rod disconnect mechanism according to claim 24, wherein said resilient member is pre-loaded with a first load to shape said resilient member opening such that said resilient member contacts said antenna rod element when an antenna is assembled thereto.

32. A method for electrically disconnecting components of a retractable antenna, the antenna components including an antenna rod element, a resilient member, and a top load element, the method comprising the steps of:

positioning the resilient member with a center rod element opening intermediate of the top load element and the rod element such that the top load element and the rod element are in electrical communication with the resilient member;

introducing a first pre-load onto the resilient member causing the member to electrically contact the antenna rod;

introducing a second load onto the resilient member when retracting the antenna; and deforming the resilient member to electrically disconnect the member from the rod element, thereby disconnecting the top load element from the rod element.

* * * * *